United States Patent [19]

Pan et al.

[11] Patent Number: 4,791,733

[45] Date of Patent: Dec. 20, 1988

[54] STUDENT'S MULTI-FUNCTION PROTRACTOR

[75] Inventors: Shih C. Pan; Ching P. Tseng, both of Tai Chung, Taiwan

[73] Assignee: Huey Bao Co., Ltd., Taiwan

[21] Appl. No.: 76,772

[22] Filed: Jul. 22, 1987

[51] Int. Cl.[4] ..... B43L 13/02

[52] U.S. Cl. ..... 33/403; 33/565

[58] Field of Search ..... 33/403, 431, 565, 566, 33/562

[56] References Cited

U.S. PATENT DOCUMENTS

| | | | |
|---|---|---|---|
| D. 165,849 | 2/1952 | Jordan | 33/565 X |
| 224,811 | 2/1980 | Wilson | 33/403 |
| 649,339 | 4/1900 | Thompson | 33/1 N |
| 2,004,951 | 6/1935 | Jensen | 33/1 N X |
| 2,190,071 | 2/1940 | Keppers | 33/403 |
| 2,624,117 | 1/1953 | Paci | 33/27.03 |
| 3,460,261 | 8/1969 | Frey | 33/403 |
| 3,925,899 | 12/1975 | Hesse et al. | 33/403 |
| 4,625,425 | 12/1986 | Senno et al. | 33/565 X |

FOREIGN PATENT DOCUMENTS

| | | | |
|---|---|---|---|
| 685004 | 4/1964 | Canada | 40/158 R |

*Primary Examiner*—Harry N. Haroian

*Attorney, Agent, or Firm*—Poms, Smith, Lande & Rose

[57] ABSTRACT

A student's multi-function protractor for conveniently drawing different geometric figures including a transparent middle plate which fits on the retainment space between an upper base and a lower base. The middle plate is rotatable in the retainment space. The circumferential edge with the middle plate of the upper base has a 360 degree scale. In addition, the middle plate has a plurality of parallel grooves which are scattered on one side from the central point for providing direct drawings. By accompanied with the grooves, scales and the indication elements on the middle plate, the protractor of this invention is used to easily draw different geometric figures.

1 Claim, 8 Drawing Sheets

STUDENT'S MULTI-FUNCTION PROTRACTOR

BACKGROUND OF THE INVENTION

The present invention relates to a student's multi-function protractor comprising an upper base, a middle plate and a lower base which provides up to 360 degrees rotation for drawing various geometric figures.

Conventional protractors are semi-circular in shape; therefore, if an angle measured by a conventional protractor is more than 180 degrees, the protractor should be rotated 180 degrees for a second measurement. This results in complexity of measurement. Further, using the conventional protractor to draw a line is also inconvenient because two end-points should first be marked off, then connected using a straight rule. Especially, conventional protractor cannot be used to draw other geometric figures, such as triangles, multi-angled figures and so on.

SUMMARY OF THE INVENTION

Therefore, a primary objective of this invention is to provide a rotatable multi-functional protractor on which may equidistant parallel longitudinal grooves are bored for working in conjunction with the rotatable characteristic of the protractor so as to draw various geometric figures.

Further objectives and advantages of the present invention will become apparent as the following description proceeds, and the features of novelty which characterize the invention be pointed out with particularity in the claims annexed to and forming a part of this invention.

DETAILED DESCRIPTION OF THE PREFERRED EMBODIMENT

Figure 1:
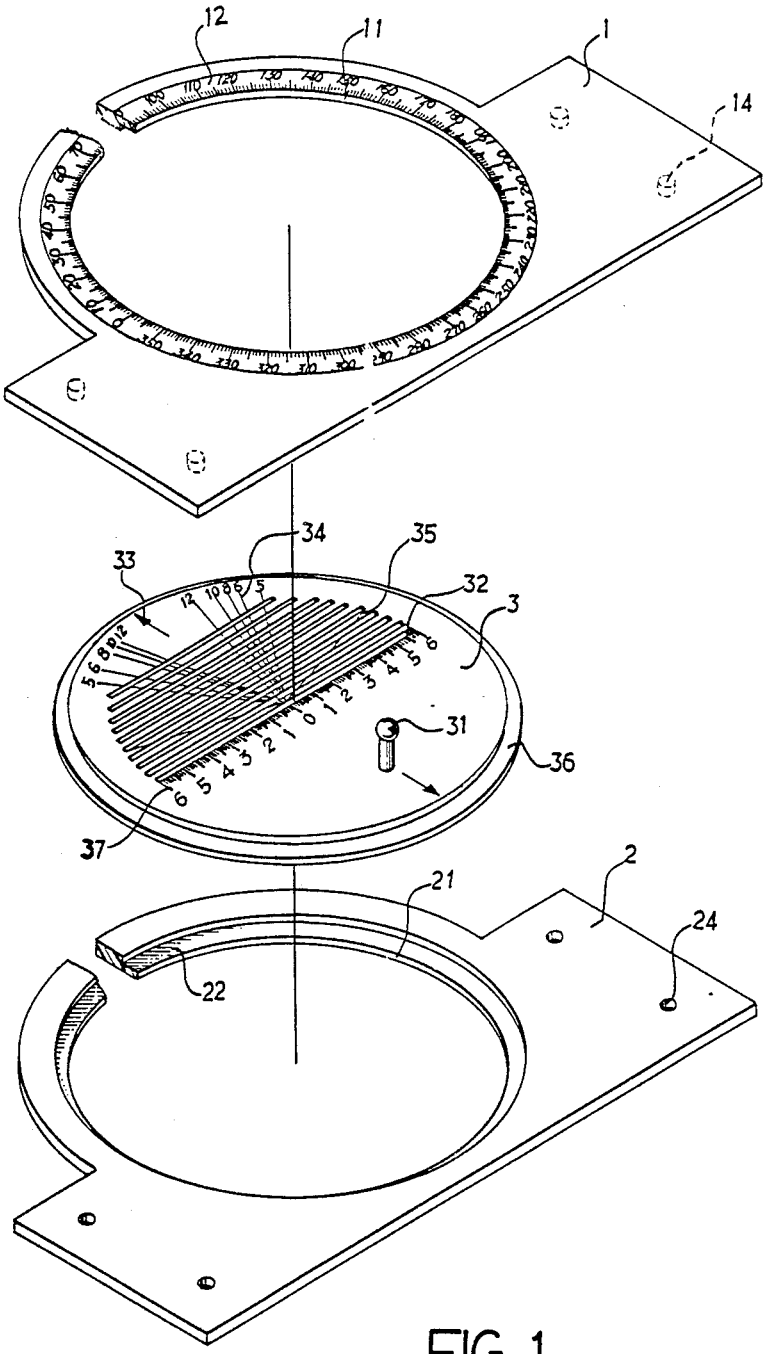
FIG. 1 shows an exploded view of this invention.
Figure 2:
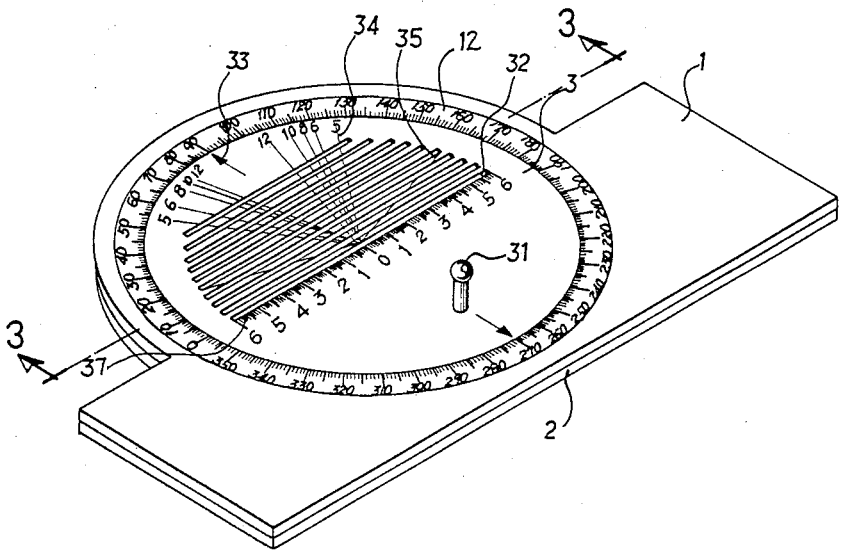
FIG. 2 shows a perspective view of this invention.

As shown in FIGS. 1 and 2, this invention comprises an upper base 1, a middle plate 3 and a lower base 2. The upper and lower bases 1, 2 have substantially the same profile and each base has a respective central circumference 11 or 21. The upper base 1 and the lower base 2 are engageable by means of four protuberances 14 installed on the back surface of the upper base 1 for fitting into four corresponding recesses 24 on the front of the lower base 2. Further, the upper base 1 has a circular scaling extension 12, on the top of the upper circumference 11, on which a 360 degree scale is set. The lower circumference of the central circumference 21 of the lower base 2 also has a circular extension 22, which, in conjunction with two central circumferences 11 and 21, creates a circular cavity therebetween when the upper base 1 and the lower base 2 are engaged together.

The middle plate 3 is a transparent circular plate on which are set an appropriate number of equidistant parallel grooves 32 from one side of the central point (referenced point) towards the edge. The groove 32 passing through the central point further has linear scales 37 on one side thereof. Two indication arrows 33 perpendicular to the groove 32 are included near the edge of the middle plate 3. Corresponding to the imaginary connection line of the central point and the indication arrow 33, there are divided several more special angle indications 34 and 35, then provides the convenience of drawing the geometric figures.

Figure 3:
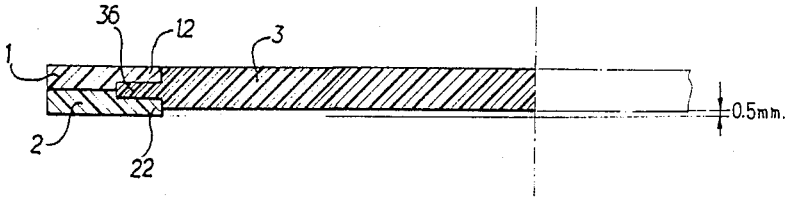
FIG. 3 shows a cross-sectional view of this invention taken along line 3—3 shown on FIG. 2.

The middle plate 3 has a circumferential flange 36 on the middle portion of the circumference of said middle plate 3 so that the middle plate 3 is slidably retained in the space between the upper base 1 and the lower base 2, as shown in FIG. 3. Especially note that the bottom of the middle plate 3 is higher than that of the lower base 2 by about 0.5 mm so as to provide an enough space for a drawing pen point. Therefore, because of the width of the grooves (about 2 mm) and the height of the groove, many kinds of pens can be applied in the protractor for drawing. In addition, on the other side without grooves 32 of the central point, the middle plate 3 comprises a rotating knob 31 which is used to rotate the middle plate for different drawings.

Figure 4:
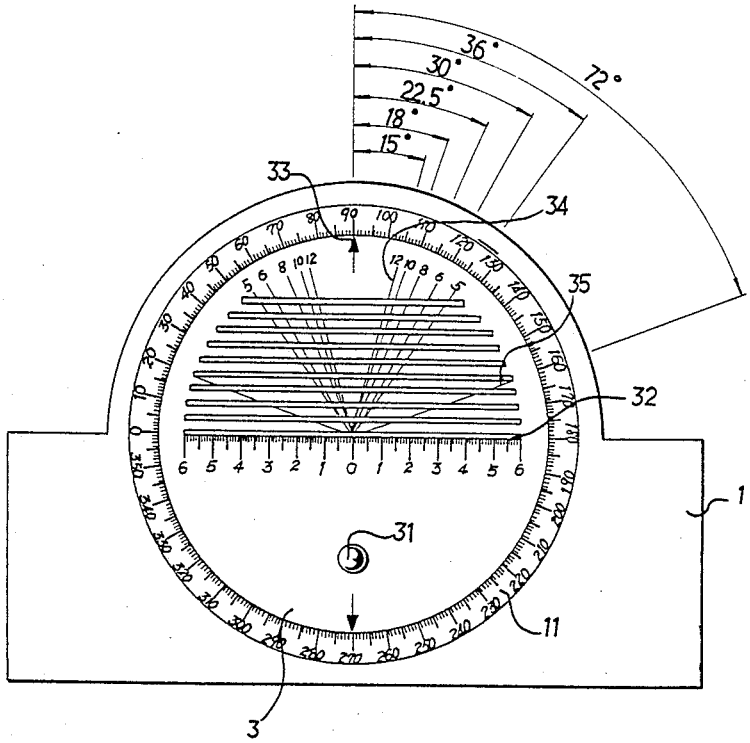
FIG. 4 shows a top view of this invention.
Figure 5A:
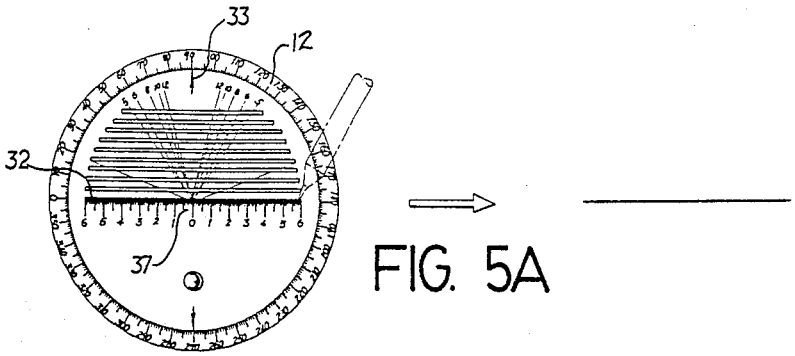
FIGS. 5A, 5B and 5C show working views of this invention illustrating the drawing of a non-parallel or bisecting line over two parallel lines.
Figure 5B:
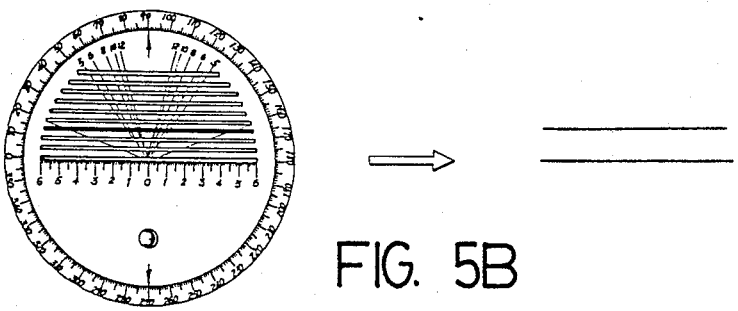
Figure 5C:
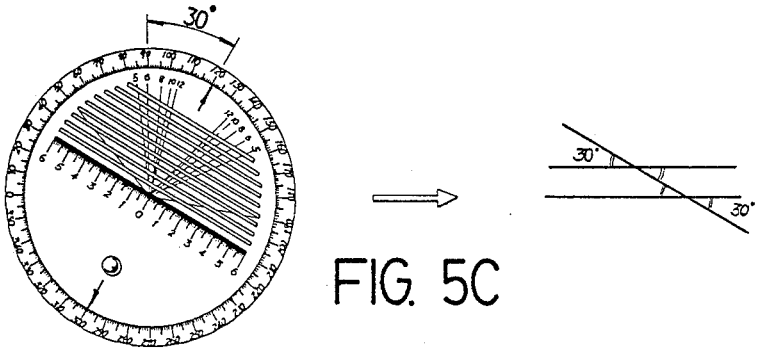
Figure 6A:
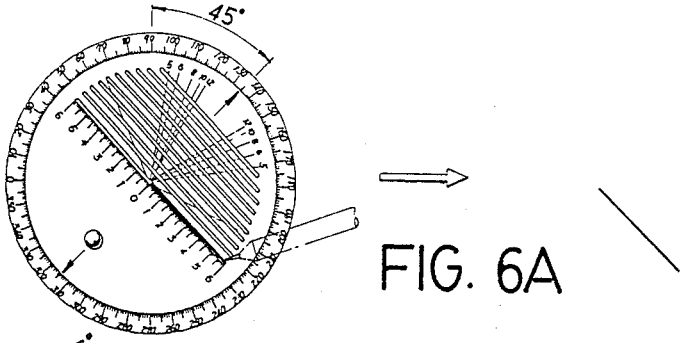
FIGS. 6A, 6B and 6C show another working views of this invention illustrating the drawing of a triangle.
Figure 6B:
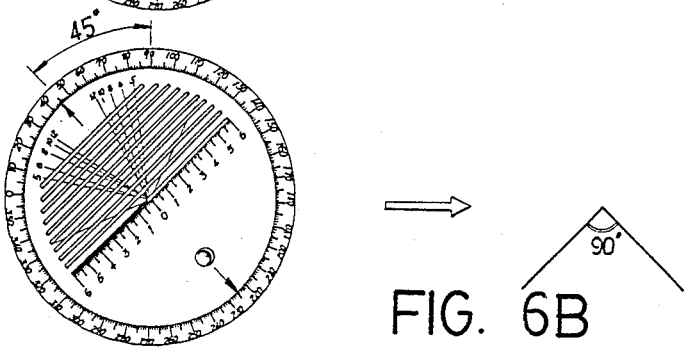
Figure 6C:
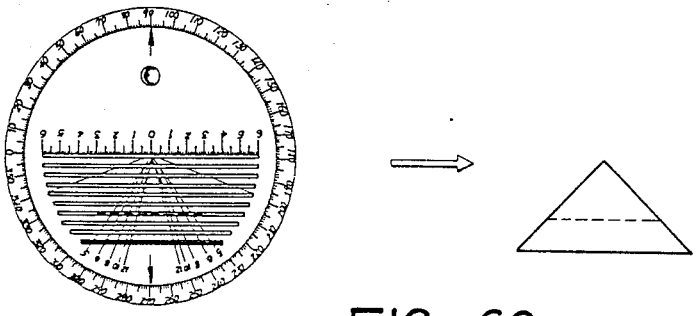
Figure 7A:
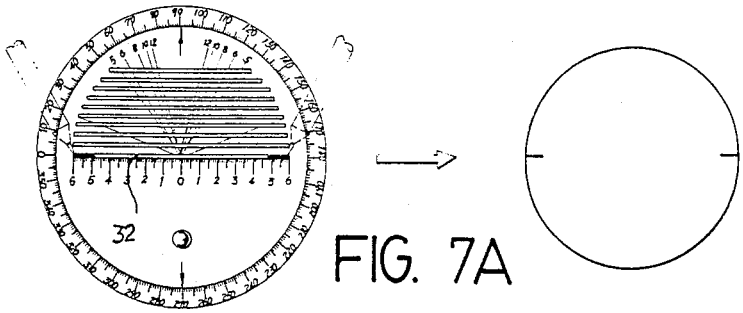
FIGS. 7A, 7B, 7C and 7D show another working views of this invention illustrating the drawing of scaling for a clock.
Figure 7B:
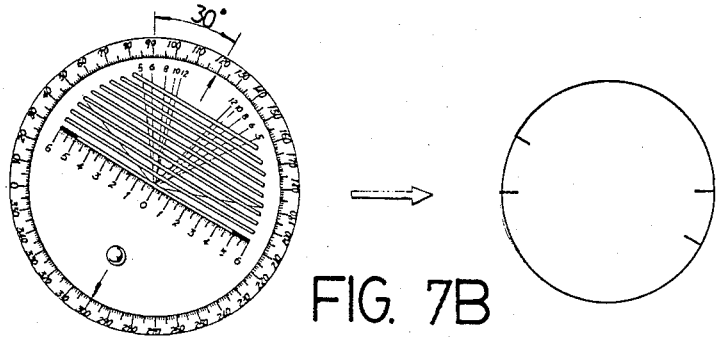
Figure 7C:
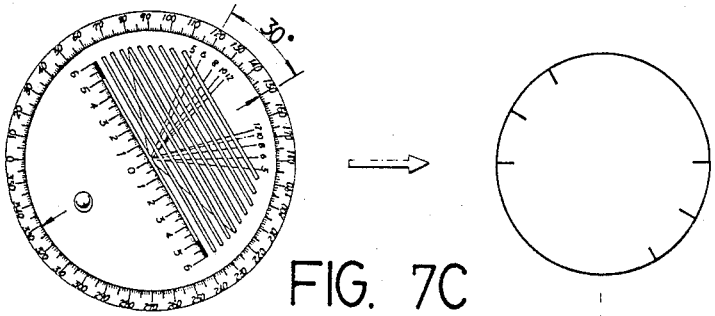
Figure 7D:
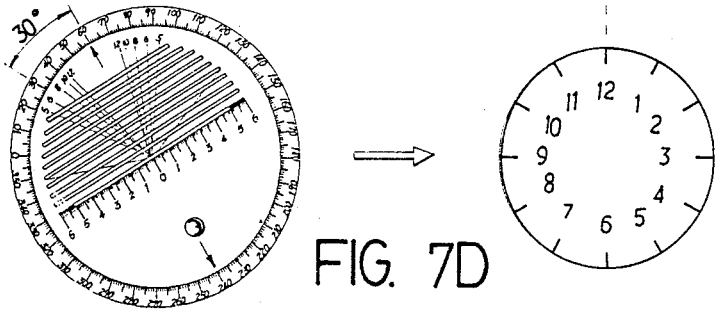
Figure 8A:
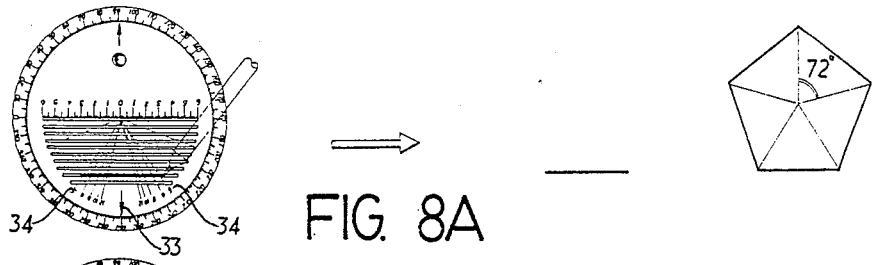
FIGS. 8A, 8B, 8C, 8D and 8E show another working views of this invention illustrating the drawing of a pentagon.
Figure 8B:
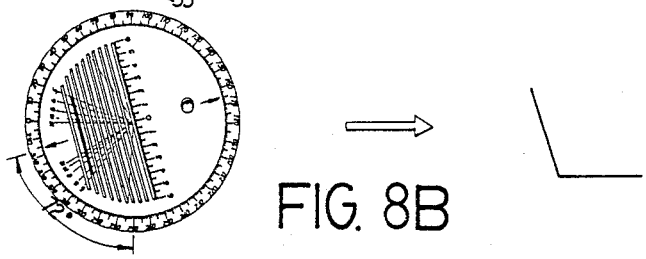
Figure 8C:
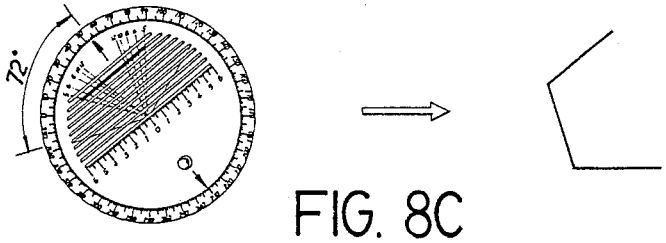
Figure 8D:
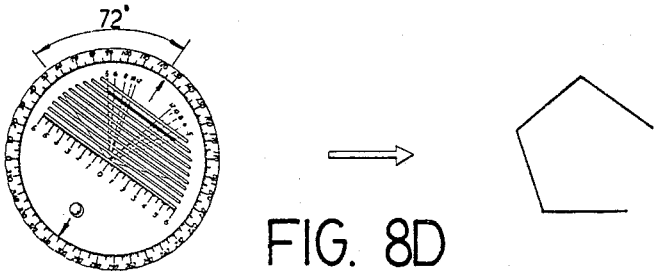
Figure 8E:
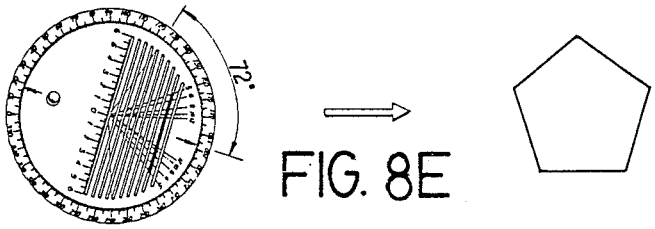
Figure 9A:
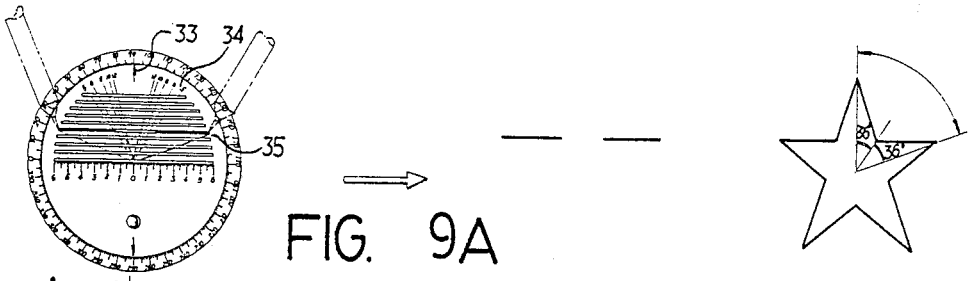
FIGS. 9A, 9B, 9C, 9D and 9E show another working views of this invention illustrating the drawing of a 5-point star.
Figure 9B:
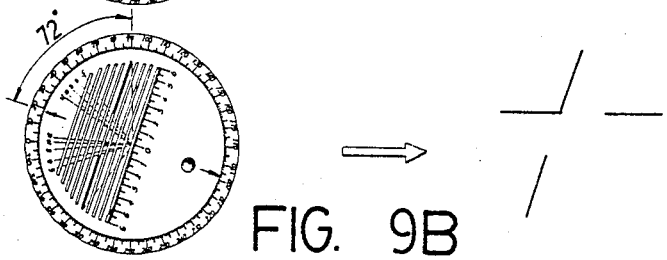
Figure 9C:
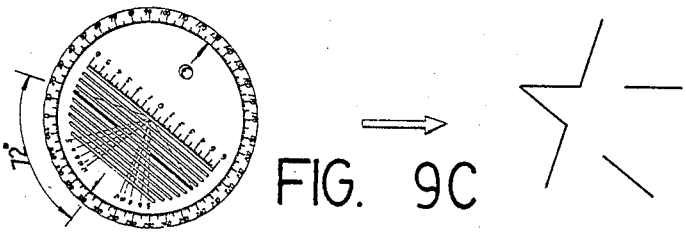
Figure 9D:
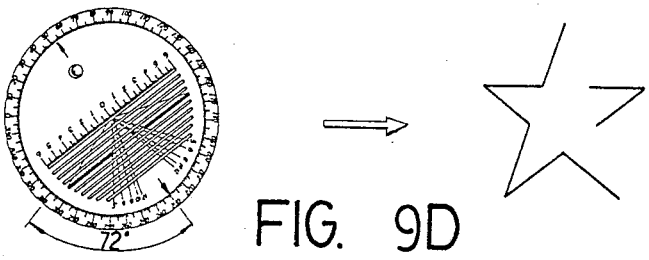
Figure 9E:
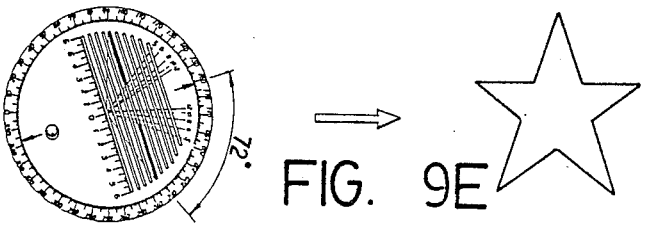

FIG. 4 shows a top view of the invention. The installation of the grooves 32 is used for drawing parallel lines and different sizes of geometric figures (because the lengths of the grooves are different). The indication arrows 33 provide reference indications and angle identifications when the middle plate 3 is rotated. The angle indications 34 respectively indicate 15, 18, 22.5, 30, 36 and 72 degrees. These angle indications 34 are provided for the convenient drawing different polygons. Especially, the greatest angle indication 35 formed an angle 72 degrees with the indication arrow 33 is used for drawing a regular pentagram.

Now referring to FIGS. 5A to 5C, 6A to 6C, 7A to 7D, 8A to 8E and 9A to 9E, various embodiments for drawing a cutting line or bisecting line of two parallel lines, a triangle, a clock, a pentagon and a regular pentagram can be seen. The drawing method will be described hereinafter as follows:

(1) In order to draw a cutting line of two parallel lines and the angle therebetween being 30 degrees, the indication arrow 33 are first aimed at the 90 degree mark of the circular scaling extension 12 and two grooves are selected for the drawing of two parallel lines. Secondly, the middle plate 3 is rotated so as to aim the indication arrow 33 at the 120 degree mark of the circular scaling extension 12 (i.e. rotate arrow 30 degrees), then a draw a line from a groove. Thus, a bisecting or cutting line passing through two parallel lines is completed.

(2) To draw an isosceles right-angled triangle, the indication arrow 33 is first aimed at the 135 degree mark and a line from central point to right is drawn. Secondly, the indication arrow 33 is aimed at the 45 degree mark and a line is drawn from central point to left so that an angle of 90 degrees is formed. Finally, the middle plate 3 is rotated so as to make the indication arrow 33 aim at the 270 degree mark and a groove is chosen depending on the desired size of the triangle to draw the last side line. Then an isosceles right-angled triangle is completed.

(3) To draw the scales of a clock, it should be noted first that the angle between each scale is 30 degrees. Therefore, first the central point of the middle plate 3 is aimed at that of the clock and the indication arrows 33 at the 90 degree mark. Then two equilateral lines are drawn from the circumference of the clock. In this manner, the middle plate 3 is rotated first 30 degrees to right and then 30 degrees to the left and the respective two equilateral lines are drawn. Finally, the middle plate 3 is rotated 30 degrees from the new positions to their respective right and left. In this way, a scale drawing is thus made.

(4) FIGS. 8A to 8E show a drawing of a regular pentagon. Because the angle from the central point to any two vertices is 72 degrees, the middle plate 3 should be rotated 72 degrees each time. As illustrated in FIG. 8, first the desired length of the sides is chosen, then the middle plate 3 is rotated in the clockwise or counterclockwise direction four times and the sides are drawn. A pentagon is thereby completed.

(5) Similar to that of the pentagon, each angle from the central point to any two vertices of a regular pentagram is 36 degrees. This drawing of the pentagram (as shown in FIGS. 9A to 9E) is performed in accordance with the angle indications 34 and 35. As the angle between the indication arrow 33 and that angle indication 35 is 72 degrees, the indication arrow 33 is considered as a vertex of the pentagram. Further, the angle indication 34 marked 36 degrees is another vertex. Therefore, draw two sides of the pentagram can be drawn directly from the groove 32 between the two angle indications 34 and 35 (as shown by the black lines shown). Then, the middle plate 3 is rotated 72 degrees in clockwise or counterclockwise direction at each time and draw the sides in this manner so that a pentagram is thus completed.

The above-mentioned embodiments of this invention are provided for illustrating the usage method for drawing of the protractor of this invention, but which do not limit the scope of the claimed invention. According to these descriptions, this invention should be well understood. Therefore, as various embodiments might be made of the above invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A student's multi-functional protractor used for drawing different geometric figures comprising:

(a) an upper base and a lower base respectively set with at least four protuberances and at least four recesses on corresponding positions of a back face of said upper base and a front face of said lower base, said protuberances of said upper base being configured for engagement within said recesses of said lower base, each of said upper and lower bases having a circular central circumference;

a first circular scaling extension being extended along an upper portion of said circular central circumfrence of said upper base, said first scaling extension having a thickness less than that of said circular central circumference of said upper base, said first circular scaling extension having a 360 degree scale thereon; and correspondingly, a second circular extension being extended along a lower portion of said circular central circumference of said lower base, said second circular extension having a thickness also less than the thickness of said circular central circumference of said lower base, so that when said upper and lower bases are engaged together, an annular cavity is created between said upper and lower bases;

(b) a rotatable middle transparent plate including a protruding circumferential flange extending radially outward from a middle of a circumference of said middle plate, said protruding circumferential flange being configured for engagement within said annular cavity formed by said upper and lower bases, said protuberances of said upper base engaging said recesses of said lower base so that said upper and lower bases are held together and said protruding circumferential flange is free to frictionally rotate within said annular cavity; and (c) said middle plate having (1) a plurality of parallel grooves with different lengths passing therethrough, said grooves being set on one side of a central point of said middle plate, (2) a rotating knob on the other side of said central point, (3) a plurality of angle-indicating lines located on said one side, said lines extending radially from said central point toward said circumference of said middle plate, and (4) two indication arrows perpendicular to said grooves, one of said arrows located on said one side and the other of said arrows located on said other side so that said arrows are located on an imaginary diametric line passing through said central point and said rotating knob, said pluralities of grooves and angle-indicating lines capable of being used with said indication arrows and said 360 degree scale on said first circular scaling extension in order to draw different geometric figures.

* * * * *